US007521101B2

(12) United States Patent
Naisby et al.

(10) Patent No.: US 7,521,101 B2
(45) Date of Patent: Apr. 21, 2009

(54) INK JET RECORDING MEDIUM

(75) Inventors: Andrew S. Naisby, Yorktown Heights, NY (US); Howard R. Dungworth, Halifax (GB); Donna Pennant, Mt. Vernon, NY (US); Joseph Suhadolnik, Yorktown Heights, NY (US)

(73) Assignee: Ciba Specialty Chemicals Corporation, Tarrytown, NY (US)

( * ) Notice: Subject to any disclaimer, the term of this patent is extended or adjusted under 35 U.S.C. 154(b) by 498 days.

(21) Appl. No.: 10/890,449

(22) Filed: Jul. 13, 2004

(65) Prior Publication Data

US 2005/0032931 A1 Feb. 10, 2005

Related U.S. Application Data

(60) Provisional application No. 60/488,341, filed on Jul. 18, 2003.

(51) Int. Cl.
*B41M 5/00* (2006.01)

(52) U.S. Cl. ..... 428/32.23; 428/32.21; 428/32.26; 428/32.27; 428/32.3; 428/32.34; 428/32.38

(58) Field of Classification Search ..... 428/32.22, 428/32.23, 32.27, 32.34, 32.38, 32.21, 32.26, 428/32.3
See application file for complete search history.

(56) References Cited

U.S. PATENT DOCUMENTS

| | | | | |
|---|---|---|---|---|
| 4,371,582 | A | 2/1983 | Sugiyama et al. | 428/341 |
| 4,575,465 | A | 3/1986 | Viola | 427/261 |
| 4,830,911 | A | 5/1989 | Kojima et al. | 428/342 |
| 5,206,071 | A | 4/1993 | Atherton et al. | 428/195 |
| 5,942,329 | A * | 8/1999 | Nakayama et al. | 428/423.1 |
| 6,245,421 | B1 | 6/2001 | Aurenty et al. | 428/304.4 |
| 6,492,005 | B1 * | 12/2002 | Ohbayashi et al. | 428/32.29 |
| 2002/0127376 | A1 * | 9/2002 | Hutter et al. | 428/195 |
| 2004/0160504 | A1 * | 8/2004 | Tomita et al. | 347/105 |
| 2005/0008795 | A1 * | 1/2005 | Dungworth et al. | 428/32.28 |
| 2007/0088118 | A1 * | 4/2007 | Dungworth et al. | 524/555 |

FOREIGN PATENT DOCUMENTS

| | | |
|---|---|---|
| EP | 0952005 | 10/1999 |
| EP | 0970819 | 1/2000 |
| EP | 1245401 | 10/2002 |
| EP | 1277590 | 1/2003 |
| WO | 00/46035 | 8/2000 |
| WO | WO 03/006251 A1 * | 1/2003 |
| WO | WO 03/037641 A2 * | 5/2003 |

OTHER PUBLICATIONS

English Language Abstract for JP 2001200199 (2001).
English Language Abstract for JP 10272830 (1998).

* cited by examiner

*Primary Examiner*—Betelhem Shewareged
(74) *Attorney, Agent, or Firm*—Tyler A. Stevenson

(57) ABSTRACT

An ink jet recording media system is described which comprises at least one coating layer that comprises a copolymer or cooligomer, which copolymer or cooligomer comprises monomer units derived from at least one monomer selected from the group consisting of the acrylate and acrylamide monomers, at least one monomer selected from the group consisting of the amine containing ethylenically unsaturated monomers and at least one monomer selected from the group consisting of the polyacrylates of polyols. The copolymer or cooligomer is at least partially neutralized with acid. The media system exhibits excellent dye wash fastness, fast dry times, high gloss and excellent light fastness.

37 Claims, No Drawings

INK JET RECORDING MEDIUM

This application claims the benefit under 35 USC 119(e) of U.S. provisional application No. 60/488,341, filed Jul. 18, 2003.

This invention relates to ink jet recording media, in particular to ink jet coating layers that comprise certain copolymers or cooligomers that comprise monomer units derived from at least one monomer selected from the group consisting of the acrylate and acrylamide monomers, at least one monomer selected from the group consisting of the amine containing ethylenically unsaturated monomers and at least one monomer selected from the group consisting of the polyacrylates of polyols. The copolymers or cooligomers are neutralized with acid, for example prior to or during the coating formulation.

BACKGROUND OF THE INVENTION

Ink jet printing technology is used for example for presentation (transparency), graphic arts, banners and signage, engineering drawing and home office applications. The performance requirements for ink jet recording media used for these applications include efficient ink absorption, fast drying, good colorfastness, high image resolution, archivability and curl performance.

The individual layers that receive ink jet ink images are referred to as ink jet media or ink jet receivers. Ink jet media may simply consist or cellulosic fiber paper or of cellulosic fibers and a filler in order that inks may be absorbed in the space between fibers.

Ink jet recording papers may also be of the coated type, which consists for example of a paper (or support), an ink-receptive layer or ink-absorbing layer or layers, and optionally a protective coating layer. The ink-receptive layer is the ink-receiving or image drying layer. Thin protective coating layers are typically employed to provide physical protection for the underlying layer or to protect the image. Protective layers may reduce tackiness, provide a glossy appearance, and like other layers, offer an ink-receptive surface that may serve as a carrier for specific components of the ink.

A barrier layer between a paper support and the ink receptive layer or layers is also typically employed.

Attempts have been made to employ certain polymers or blends of polymers as components of ink jet recording media. In general, blends are used to find the proper balance of ink absorption, dry time and image permanence.

U.S. Pat. No. 4,575,465 discloses ink jet transparencies that comprise a transparent support carrying a layer comprising a vinylpyridine/vinylbenzyl quaternary salt copolymer and a hydrophilic polymer selected from gelatin, polyvinyl alcohol and hydroxypropyl cellulose.

U.S. Pat. No. 5,206,071 teaches an ink jet film composite comprising a support, a water-insoluble, water-absorptive and ink-receptive matrix layer, which matrix layer comprises a hydrogel complex and a polymeric high molecular weight quaternary ammonium salt.

U.S. 2002/0127376 discloses cationic colloidal dispersion polymers for ink jet coatings.

JP2001200199 teaches ink jet recording media with a surface coating containing a copolymer containing a cationic group.

U.S. Pat. No. 6,245,421, WO 00/46035 and WO 00/46036 teach printable media comprising an ink receptive, thermoplastic image layer that contains a copolymer having a plurality of tertiary amine sites, which sites are at least partially neutralized with acid.

U.S. Pat. No. 4,830,911 teaches recording sheet for ink jet printers coated or impregnated with certain water soluble polymers.

JP10272830 (JP3160710B2) teaches a coating agent of an ink jet recording sheet that is prepared from a copolymer of a quaternary ammonium base, a compound having a carboxyl group and a specified compound having an alkyl ester.

It has been found that certain copolymers or cooligomers, which copolymers or cooligomers comprise monomer units derived from at least one monomer selected from the group consisting of the acrylate and acrylamide monomers, at least one monomer selected from the group consisting of the amine containing ethylenically unsaturated monomers and at least one monomer selected from the group consisting of the polyacrylates of polyols, provide for superior ink jet media when incorporated therein. The amine sites of the copolymers or cooligomers are at least partially neutralized with acid prior to film casting the coating formulation. The ink jet media, which receives ink jet ink, is provided excellent dye wash fastness, fast dry times, high gloss and excellent lightfastness.

DETAILED DESCRIPTION

The present invention relates to an ink jet recording media system that comprises a support and one or more coating layers thereon, wherein at least one coating layer comprises a copolymer or cooligomer that comprises monomer units derived from at least one monomer selected from the group consisting of the acrylate and acrylamide monomers, at least one monomer selected from the group consisting of the amine containing ethylenically unsaturated monomers and at least one monomer selected from the group consisting of the polyacrylates of polyols. The copolymer or cooligomer is at least partially neutralized with acid.

For the purposes of this invention, the terms "ink jet media", "ink jet recording media" or "ink jet media system" or "ink jet recording media system" refers to the entire composition which receives the ink jet ink, or likewise also refers to any individual layers or combinations of individual layers of the entire composition. These terms also refer to these compositions after printing with ink jet ink, that is, further comprising ink jet ink.

The term "ink receptive layer" means the ink-receiving or image-forming layer. The ink receptive layer can be considered as a sponge layer intended for the absorption of the ink.

The term "protective coating layer" means a top coating layer of the ink jet media system, or overcoat layer, that may be employed to provide specific properties as outlined above. Protective coating layers are typically thin in comparison to the ink-receptive layer. The protective coating layer is the outermost layer, and must allow for ink penetration or may be applied in a subsequent lamination step.

The term "support" refers to the base substrate of the ink jet media, for example paper itself. The present supports are naturally occurring materials or are synthetic.

The term "monomer units derived from" means the starting monomer is reacted into, and thus is part of, the finished copolymer or cooligomer. Each individual reacted monomer molecule is a "monomer unit" when part of a copolymer or cooligomer.

The present copolymers or cooligomers are prepared by free radical polymerization techniques, which techniques are well known to those skilled in the art. For instance, the present copolymers or cooligomers are emulsion copolymers or cooligomers, prepared by the methods described in U.S. 2002/0127376, the disclosure of which is hereby incorporated by reference.

The present copolymers or cooligomers are at least partially neutralized with acid. This pH adjustment, or "combination with acid" or "neutralization with acid" or "addition of acid" may be performed at any stage. For example, the neutralization with acid is performed at any stage during the preparation of the copolymer or cooligomer, the formulation of the coating resin, or the preparation of the ink jet media. The acid partially or completely neutralizes the amine sites of the copolymers or cooligomers.

Advantageously the acid, for example acetic acid, may be ultimately removed from the ink jet media upon drying. Drying takes place for instance upon heating or at ambient temperature.

For example, the present copolymers or cooligomers are formulated into media coating formulations (coatings). The coating formulations are adjusted with acid to a pH of from about 3 to about 7. For instance, the pH of the present coating formulations is from about 3 to about 6, from about 4 to about 7, or from about 4 to about 6. The coating formulations comprise for example the emulsion copolymer or cooligomer, water and other ingredients. That is, the coating formulations are for example aqueous coating formulations (aqueous coatings). That is to say, the coating layers comprising the present neutralized copolymers or cooligomers exhibit said pH limits prior to drying or curing.

Acids that are convenient to employ for neutralization of the copolymers or cooligomers are for example mineral acids, such as sulfuric or hydrochloric acids, or organic acids, such as carboxylic acids or sulfonic acids. For example, the acid employed for neutralization is acetic acid, propionic acid, glycolic acid, lactic acid, and the like.

Volatile acids like acetic acid may be removed (may evaporate) from the ink jet media upon drying. This "removal" of the neutralization acid is observable for instance by surface reflective IR spectroscopy.

For example, when volatile acids are employed, greater than about 80 mol % of the neutralization acid is ultimately removed from the ink jet media. For instance, greater than about 90%, about 95% or greater than about 98 mol % of the volatile acid is ultimately removed. The acid is removed upon drying or curing of the ink jet media with heat or at ambient temperature.

The present copolymers or cooligomers comprise from about 99.89 to about 0.1 weight percent monomer units derived from at least one monomer selected from the group consisting of the acrylate and acrylamide monomers, about 99.89 to about 0.1 weight percent monomer units derived from at least one monomer selected from the group consisting of amine containing ethylenically unsaturated monomers, and from about 99.8 to about 0.01 weight percent monomer units derived from at least one monomer selected from the group consisting of the polyacrylates of polyols.

For example, the present copolymers or cooligomers comprise from about 20 to about 80 weight percent monomer units derived from at least one monomer selected from the group consisting of the acrylate and acrylamide monomers, about 20 to about 80 weight percent monomer units derived from at least one monomer selected from the group consisting of amine containing ethylenically unsaturated monomers, and from about 0.01 to about 10 weight percent monomer units derived from at least one monomer selected from the group consisting of the polyacrylates of polyols.

For example, the present copolymers or cooligomers comprise from about 30 to about 80 weight percent monomer units derived from at least one monomer selected from the group consisting of the acrylate and acrylamide monomers, about 20 to about 70 weight percent monomer units derived from at least one monomer selected from the group consisting of amine containing ethylenically unsaturated monomers, and from about 0.1 to about 1.0 weight percent monomer units derived from at least one monomer selected from the group consisting of the polyacrylates of polyols.

For example the present copolymers or cooligomers comprise from about 0.2 to about 0.6 weight percent monomer units derived from at least one monomer selected from the group consisting of the polyacrylates of polyols.

The weight percent monomer units is based on the weight of the polymer. That is, it does not include other ingredients of an emulsion polymer such as surfactant, initiator, solvent, biocides, and the like.

The present copolymers or cooligomers are at a minimum "terpolymers", having monomer units derived from at least three different ethylenically unsaturated monomers, the three classes being "acrylate and acrylamide monomers", "amine containing ethylenically unsaturated monomers" and "polyacrylates of polyols".

The present copolymers or cooligomers comprise monomer units derived from one or more than one monomer selected from the group consisting of the acrylate and acrylamide monomers. The copolymers or cooligomers comprise monomer units derived from one or more than one amine containing ethylenically unsaturated monomer. The copolymers and cooligomers comprise monomer units derived from one or more than one polyacrylate of a polyol monomer.

The monomers according to this invention are polymerizable allylic, vinylic or acrylic compounds. That is, they are ethylenically unsaturated.

The acrylate monomers of this invention are for example acrylic or methacrylic esters of alcohols containing from 1 to 22 carbon atoms.

The acrylate monomers of this invention are for example acrylic acid, methacrylic acid, methyl acrylate, ethyl acrylate, butyl acrylate, 2-ethylhexyl acrylate, isobornyl acrylate, methyl methacrylate, ethyl methacrylate and butyl methacrylate.

The acrylamide monomers of this invention are for example acrylamide, methacrylamide, N-methylacrylamide, N,N-dimethylacrylamide, N,N-dimethyl(meth)acrylamide, N-isopropyl(meth)acrylamide, diacetone acrylamide or N-morpholinoacrylamide.

For instance, the present acrylate and acrylamide monomers are selected from the group consisting of acrylamide, methacrylamide, methyl acrylate, methyl methacrylate, diacetone acrylamide and N,N-dimethyl acrylamide.

For example, the present acrylate and acrylamide monomers are selected from the group consisting of acrylamide, methacrylamide and methylmethacrylate.

The amine containing ethylenically unsaturated monomers of this invention are for example dialkylaminoalkyl acrylates or methacrylates, dialkylaminoalkylacrylamides or methacrylamides, allyl amine, 2-vinylpyridine, 4-vinylpyridine or N',N'-dimethylaminoethyl-N,N-dimethylammonium-N-propyl methacrylate chloride.

The amine containing ethylenically unsaturated monomers of this invention are for example dimethylaminoethyl acrylate, dimethylaminoethyl methacrylate, diethylaminoethyl methacrylate, dimethylaminopropyl acrylamide, tert-butylaminoethyl methacrylate, dimethylaminopropyl methacrylamide, allyl amine, 2-vinylpyridine or 4-vinylpyridine. The amine containing ethylenically unsaturated monomers may contain a quarternary ammonium group, for example N',N'-dimethylaminoethyl-N,N-dimethylammonium-N-propyl methacrylate chloride.

For example, the present amine containing ethylenically unsaturated monomers are dimethylaminopropyl acrylamide or dimethylaminopropyl methacrylamide.

For instance, the amine containing ethylenically unsaturated monomers are dimethylaminoethyl methacrylate or tert-butylaminoethyl methacrylate.

Alkyl is for instance methyl, ethyl, n-propyl, iso-propyl, n-, sec-, iso- and tert-butyl, 2-ethylbutyl, n-pentyl, isopentyl, 1-methylpentyl, 1,3-dimethylbutyl, n-hexyl, 1-methylhexyl, n-heptyl, isoheptyl, 1,1,3,3-tetramethylbutyl, 1-methylheptyl, 3-methylheptyl, n-octyl or 2-ethylhexyl.

The polyacrylates of polyols are acrylic and/or methacrylic esters of aromatic, aliphatic or cycloaliphatic polyols.

Aromatic polyols are typically hydroquinone, 4,4'-dihydroxydiphenyl, 2,2-bis(4-hydroxyphenyl)propane and cresols.

Aliphatic and cycloaliphatic polyols are for example alkylene polyols containing 2 to 12 carbon atoms, including ethylene glycol, 1,2- or 1,3-propanediol, 1,2-, 1,3- or 1,4-butanediol, pentanediol, hexanediol, octanediol, dodecanediol, diethylene glycol, triethylene glycol, 1,3-cyclopentanediol, 1,2-, 1,3-or 1,4-cyclohexanediol, 1,4-dihydroxymethylcyclohexane, glycerol, tris(β-hydroxyethyl)amine, trimethylolethane, trimethylolpropane, pentaerythritol, dipentaerythritol, tripentaerythritol and sorbitol.

The polyols may be esterified partially or completely with acrylate or methacrylate groups, in which case the free hydroxyl groups of the partial esters may be modified, for example etherified, or esterified with other carboxylic acids.

The polyacrylates of polyols comprise at least two acrylate groups. The polyols comprise at least two hydroxy groups. Therefore the simplest polyacrylate of a polyol according to this invention is a diacrylate of a diol, for example the diacrylate of butanediol. That is to say, the term "poly" of polyacrylate and polyol means 2 or more, for example 2, 3, 4, 5 or 6. The polyacrylates are acrylic esters or methacrylic esters, or mixtures thereof.

The polyacrylates of polyols of this invention are for example ethylene glycol diacrylate, propylene glycol diacrylate, neopentyl glycol diacrylate, hexamethylene glycol diacrylate, 1,4-butanediol diacrylate, 1,4-butanediol dimethacrylate, bisphenol A diacrylate, bisphenol A diamethacrylate, 4,4'-bis(2-acryloyloxyethoxy)diphenylpropane, trimethylolpropane triacrylate, tris(2-acryloylethyl) isocyanurate, trimethylolethane triacrylate, trimethylolpropane trimethacrylate, trimethylolethane trimethacrylate, tetramethylene glycol dimethacrylate, triethylene glycol dimethacrylate, tetraethylene glycol diacrylate, pentaerythritol diacrylate, pentaerythritol triacrylate, pentaerythritol tetraacrylate, dipentaerythritol diacrylate, dipentaerythritol triacrylate, dipentaerythritol tetraacrylate, dipentaerythritol pentacrylate, dipentaerythritol hexacrylate, tripentaerythritol octacrylate, pentaerythritol dimethacrylate, pentaerythritol trimethacrylate, dipentaerythritol dimethacrylate, dipentaerythritol tetramethacrylate, tripentaerythritol octamethacrylate, 1,3-butanediol diacrylate, 1,3-butanediol dimethacrylate, sorbitol triacrylate, sorbitol tetraacrylate, pentaerythritol-modified triacrylate, sorbitol tetramethacrylate, sorbitol pentacrylate, sorbitol hexacrylate, glycerol di-and-triacrylate or 1,4-cyclohexanediacrylate. Acrylates of these monomers may be interchanged with methacrylates and vice versa.

The present polyacrylate of a polyol is for example pentaerythritol triacrylate.

The copolymers or cooligomers of this invention may further comprise monomer units derived from at least one ethylenically unsaturated monomer selected from the group consisting of associative monomers, ethylenically unsaturated monomers containing quaternary ammonium groups, hydroxy containing ethylenically unsaturated monomers or other ethylenically unsaturated monomers.

Associative monomers are for instance stearyl ethoxy (20) methacrylate, stearyl ethoxy (10) allyl ether, poly(ethylene glycol)(meth)acrylate, poly(ethylene glycol)monomethyl ether mono(meth)acrylate, poly(ethylene glycol)acrylate and poly(ethylene glycol)monomethyl ether monoacrylate.

Ethylenically unsaturated monomers containing quaternary ammonium groups according to this invention are for example vinylbenzyltrimethylammonium chloride, methacryloyloxyethyltrimethylammonium chloride, methacrylamidopropyltrimethylammonium chloride, N,N-dimethylaminoethylacrylate methyl chloride quaternary salt (DMAEA.MCQ), diallyldimethylammonium chloride (DADMAC), and the like.

Hydroxy containing ethylenically unsaturated monomers according to this invention are for example N-methylolacrylamide, N-methylolmethacrylamide, N-(2-hydroxypropyl) acrylamide, N-(2-hydroxypropyl)methacrylamide, 2-hydroxyethylacrylate, 2-hydroxyethyl(meth)acrylate (HEMA), hydroxypropyl acrylate, hydroxypropyl(meth)acrylate, hydroxybutylacrylate, hydroxybutyl(meth)acrylate, butanediol monovinyl ether or allyl alcohol.

For example, the present hydroxy containing ethylenically unsaturated monomers are N-methylolacrylamide, N-methylolmethacrylamide, N-(2-hydroxypropyl)acrylamide, N-(2-hydroxypropyl)methacrylamide, 2-hydroxyethylacrylate, 2-hydroxyethyl(meth)acrylate (HEMA) or glycerol mono ((meth)acrylate).

For example, the present hydroxy containing ethylenically unsaturated monomers are N-methylolacrylamide, N-(2-hydroxypropyl)methacrylamide, 2-hydroxyethyl(meth)acrylate (HEMA) or glycerol mono((meth)acrylate).

For instance, the present hydroxy containing ethylenically unsaturated monomer is N-methylolacrylamide.

Other ethylenically unsaturated monomers according to this invention are for example N-vinyl-2-pyrrolidone, vinyl methylulfone, vinyl acetate, N-vinylformamide, N-vinylacetamide, N-vinyl-N-methylacetamide, styrene, substituted styrenes such as α-methylstyrene, acrylonitrile, methacrylonitrile, vinyl chloride, vinylidene chloride, vinyl ethers, vinyl esters and N-vinyl amides.

The alcohols of 1 to 22 carbon atoms are for example alcohols of methyl, ethyl, propyl, isopropyl, n-butyl, sec-butyl, isobutyl, tert-butyl, 2-ethylbutyl, n-pentyl, isopentyl, 1-methylpentyl, 1,3-dimethylbutyl, n-hexyl, 1-methylhexyl, n-heptyl, isoheptyl, 1,1,3,3-tetramethylbutyl, 1-methylheptyl, 3-methylheptyl, n-octyl, 2-ethylhexyl, benzyl, cyclohexyl or cyclopentyl.

For instance, the present copolymers or cooligomers comprise monomer units derived from at least one monomer selected from the group consisting of acrylamide, methacrylamide, methyl acrylate, methyl methacrylate, diacetone acrylamide and N,N-dimethyl acrylamide, monomer units derived from at least one monomer selected from the group consisting of dimethylaminoethyl methacrylate, t-butylaminoethyl methacrylate and dimethylaminopropyl methacrylamide and monomer units derived from pentaerythritol triacrylate.

For example, the present copolymers or cooligomers comprise monomer units derived from at least one monomer selected from the group consisting of acrylamide, methacrylamide and methylmethacrylate, monomer units derived from at least one monomer selected from the group consisting of dimethylaminoethyl methacrylate and t-butylaminoethyl methacrylate and monomer units derived from pentaerythritol triacrylate.

For instance, the present copolymers or cooligomers comprise monomer units derived from methyl methacrylate, dimethylaminoethyl methacrylate or t-butylaminoethyl methacrylate and pentaerythritol triacrylate.

For instance, the present copolymers or cooligomers comprise monomer units derived from methyl methacrylate, dimethylaminoethyl methacrylate or t-butylaminoethyl methacrylate, pentaerythritol triacrylate and stearyl ethoxy (10) allyl ether or poly(ethylene glycol) 350 monomethyl ether mono(meth)acrylate.

The copolymers or cooligomers of this invention may be of any molecular weight. They may for example have a molecular weight of about 10,000 to about 2 million.

The copolymers or cooligomers of this invention are advantageously employed in any layer of an ink jet ink recording media system. They may be employed in one coating layer, more than one of the layers, or in all of the layers.

The support itself may be the ink jet ink receptive layer. In this instance the copolymers or cooligomers are advantageously employed as a coating directly on the support.

Accordingly, an object of this invention is an ink jet media system which comprises a coating directly on a support, wherein the coating comprises a present copolymer or cooligomer.

The ink jet media systems of this invention may comprise one or more than one ink jet receptive layer. The present copolymers or cooligomers may advantageously be employed in one or more than one of the receptive layers.

Accordingly, another object of the invention is an ink jet media system which comprises a support and at least one ink jet ink receptive layer, wherein one or more than one of said layers comprises a present copolymer or cooligomer.

Another object of the invention is an ink jet media system which comprises a support, at least one ink jet ink receptive layer, and a protective coating layer, which protective coating layer comprises a present copolymer or cooligomer.

Another object of the invention is an ink jet media system which comprises a support, at least one ink jet ink receptive layer, and a barrier layer between the support and the ink receptive layer or layers, wherein one or more than one of said receptive layers comprises a present copolymer or cooligomer.

It is also contemplated that the present copolymers or cooligomers are advantageously employed as a component of the ink jet ink.

Accordingly, another object of the invention is an ink jet media system which comprises ink jet ink and a present copolymer or cooligomer.

Supports are for example paper or a transparent plastic. Supports also include translucent plastics, matte plastics, opaque plastics, papers, and the like.

Supports may be for example cellulose esters, cellulose acetate, polyesters, polystyrene, polyethylene, poly(vinyl acetate), polypropylene, polycarbonate, polymethacrylic acid and methyl and ethyl esters, polyamides such as nylons, polyesters such as poly(ethylene terephthalate) (PET), polyimides, polyethers, polyvinyl chloride and polysulfonamides.

Barrier layers are advantageously employed between a paper support and the ink receptive layer. The barrier layer is for example polyolefin, for instance polyethylene. The barrier layer may also be a metal foil, such as aluminum foil.

Coating layers comprising the copolymers and cooligomers of this invention are cured with any conventional technique. For example, the present coating layers are cured air dried under ambient conditions, are oven-cured, or are photocured.

The copolymers and cooligomers of this invention may be blended with a wide variety of polymers or oligomers employed in ink jet media systems, for example neutral, anionic and cationic polyvinylalcohol (PVOH) and gelatin.

Polymers typically employed in ink jet media systems, generally in the ink receptive layer, include gelatin, starch, styrene butadiene rubber latex, nitrile butadiene rubber latex, polyethylene glycol, polyacrylamide, polyvinylalcohol, vinyl alcohol/vinyl acetate copolymer, methyl cellulose, hydroxymethyl cellulose, hydroxyethyl cellulose, hydroxypropy methyl cellulose, hydroroxypropyl ethyl cellulose, hydroxyethyl methyl cellulose, carboxymethyl cellulose and poly(N-vinyl pyrrolidone).

The copolymers and cooligomers of this invention are advantageously employed with conventional cationic polymers, for example cationic polymers derived for example from one or more monomers selected from quaternary or acid salts of dialkylaminoalkyl acrylates and methacrylates, the quaternary or acid salts of dialkylaminoalkylacrylamides and methacrylamides, N,N-diallyldialkyl ammonium halides, Mannich products, and the like. Representative are N,N-dimethylaminoethylacrylate methyl chloride quaternary salt (DMAEA.MCQ), diallyldimethylammonium chloride (DADMAC), and the like.

Other suitable components may be present in the ink jet media systems and coatings of the present invention.

Additional components include for example pigments and fillers, for example amorphous and crystalline silica, aluminum trihydrate, kaolin, talcum, chalk, betonite, zeolites, glass beads, calcium carbonate, potassium sodium aluminum silicate, diatomaceous earth, silicates of aluminum and magnesium and mixtures thereof. Titanium doxide may also be used for certain applications. Organic particulates which may be employed include polyolefins, polystyrene, polyurethane, starch, poly(methyl methacrylate) and polytetrafluoroethylene. Pigments, fillers and organic particulates may be employed in coating layers of the present invention from about 0.1 to about 15% by weight, based on the weight of the dry coating. Polyolefins are for example polypropylene or polyethylene.

The present copolymers and cooligomers may advantageously be employed as a binder or part of a binder for a nanoporous or microporous ink jet media system. As known in the art, the binder may comprise a minority of the coating layer, for example less than about 40% by weight, for instance less than about 25% by weight, or less than about 10% by weight.

Paper substrates are for example advantageously coated with clay.

Additional additives also include surface active agents which control wetting or spreading action of the coating mixture, antistatic agents, thickeners, suspending agents, particulates which control the frictional properties or alter the reflective properties or act as spacers, pH controlling compounds, light stabilizers, antioxidants, humectants, bacteriostats, crosslinking agents, optical brighteners, etc.

Specific examples are starch, xanthan gum, quaternary ammonium salts, chitin, cellulose derivatives, and water soluble metal salts, for instance salts of Ca, Ba, Mg or salts of the rare earth metal series.

Stabilizer systems have been developed for the ink colorants. These stabilizers are also employed in the ink jet media systems of the present invention. They are disclosed for example in U.S. Pat. Nos. 5,782,963 and 5,855,655, the relevant disclosures of which are hereby incorporated by reference.

Additional additives that are advantageously employed as components of coating layers of an ink jet media system include those of the known classes of polymer stabilizers. For example, polymer stabilizers selected from the group consisting of ultraviolet light absorbers, hindered amine light stabilizers (HALS), and antioxidants.

For example, suitable additional additives are selected from:

Antioxidants selected from the group consisting of alkylated monophenols, alkylthiomethylphenols, hydroquinones and alkylated hydroquinones, tocopherols, hydroxylated thiodiphenyl ethers, alkylidenebisphenols, hindered phenols derived from benzyl compounds, hydroxybenzylated malonates, aromatic hydroxybenzyl compounds, triazine-based hindered phenols, benzylphosphonates, acylaminophenols, esters of β-(3,5-di-tert-butyl-4-hydroxyphenyl)propionic acid with mono- or polyhydric alcohols, esters of β-(5-tert-butyl-4-hydroxy-3-methylphenyl)propionic acid with mono- or polyhydric alcohols, esters of β-(3,5-dicyclohexyl-4-hydroxyphenyl)propionic acid with mono- or polyhydric alcohols, esters of 3,5-di-tert-butyl-4-hydroxyphenyl acetic acid with mono- or polyhydric alcohols, amides of β-(3,5-di-tert-butyl-4-hydroxyphenyl)propionic acid, ascorbic acid and aminic antioxidants, for example N,N'-di-isopropyl-p-phenylenediamine.

Antioxidants are for example phenolic antioxidants, for example salts of hydroxy substituted benzoic acids, for example salts of salicylic acid and salts of hydroxyl substituted benzoic acids further substituted with alkyl groups.

UV absorbers and light stabilizers selected from the group consisting of 2-(2-hydroxyphenyl)-2H-benzotriazoles, for example known commercial hydroxyphenyl-2H-benzotriazoles, 2-hydroxybenzophenones, esters of substituted and unsubstituted benzoic acids, for example 4-tertbutyl-phenyl salicylate,acrylates and malonates, oxamides, tris-aryl-o-hydroxyphenyl-s-triazines and sterically hindered amine stabilizers, for example N—H, N-acyl, N-oxyl, N-hydroxyl, N-alkyl, N-alkoxy and N-hydroxyalkoxy hindered amines.

For example, the nitroxyl, hydroxylamine and hydroxylamine salt stabilizers as disclosed in U.S. Pat. No. 6,254,724 are advantageously used in the recording media of the present invention. The relevant parts of U.S. Pat. No. 6,254,724 are hereby incorporated by reference.

For instance, UV absorbers are advantageously employed in protective coating layers of the present invention, whether the protective coating layer is part of the prepared recording media system or whether it is applied in a subsequent lamination step.

Another object of the present invention is a method for preparing an ink jet media system, which method comprises applying one or more coating layers on a support, wherein at least one of the coating layers comprises a present copolymer or cooligomer.

Any known method may be employed in the application of the individual coating layers of the present ink jet media systems. Known methods are for example Mayer bar coating, reverse roll coating, roller coating, wire-bar coating, dip-coating, air-knife coating, slide coating, curtain coating, doctor coating, flexographic coating, wound wire coating, slot coating, slide hopper coating and gravure coating.

Inks for ink jet printing are well known. These inks comprise a liquid vehicle and a dye or pigment dissolved or suspended therein. The liquid vehicle employed comprises water or a mixture of water and a water miscible organic solvent. The inks may also be vehicles for additives or other components that are to be incorporated into the recording media system.

Protective coating layers are typically about 1 micron thick. Supports are typically from about 12 microns to about 500 microns thick. Ink receptive layers are typically about 0.5 to about 30 microns thick.

The following Examples are for illustrative purposes only and are not to be construed as limiting the present invention in any manner whatsoever.

The present Examples demonstrate the excellent dry times, print quality, wash fastness and light fastness of the of the ink jet media prepared according to the present invention.

The Encad and Epson printers are piezo printers. The Hewlett Packard printer is a thermal printer.

Unless otherwise noted, ratios and levels are in weight percent.

The following media resin compositions are prepared:

| | | |
|---|---|---|
| A | MMA/DMAEMA/RS10AE (50/30/20) | 0.5% PETA |
| B | MMA/DMAEMA/RS10AE (40/40/20) | 0.5% PETA |
| C | MMA/DMAEMA/RS10AE (50/30/20) | 0.25% PETA |
| D | MMA/DMAEMA/RS10AE (60/30/10) | 0.5% PETA |
| E | MMA/DMAEMA/RS10AE (60/40) | 0.5% PETA |
| F | MMA/DMAEMA/RS10AE (50/40/10) | 0.5% PETA |
| G | MMA/DMAEMA (40/60) | 0.5% PETA |
| H | MMA/DMAEMA (60/40) | 0.25% PETA |
| J | MMA/DMAEMA/RS10AE (40/50/10) | 0.25% PETA |

The control resin is a 50/50 (w/w) copolymer of MMA/DMAEMA.

The polymers are prepared according to conventional free radical polymerization techniques, for example according to the disclosure of U.S. 2002/0127376.

MMA=Methyl methacrylate

DMAEMA=Dimethylaminoethyl methacrylate

RS10AE=Steareth 10 mole ethoxylate allyl ether

MPEG350MA=Methoxy PEG 350 methacrylate (PEG is polyethylene glycol)

PETA=Pentaerythritol triacrylate

EXAMPLE 1

Wash Fastness

Resin media coating formulations are prepared as below. The control and the polymers of sample G, E and J are supplied at 30% solids in water.

| | | | |
|---|---|---|---|
| Control, G, E (30% solids) | 50 g | J (30% solids) | 33.3 g |
| Distilled Water | 45 g | Distilled Water | 40 g |
| Ethanol | 5 g | Ethanol | 10 g |

The formulations are adjusted to pH 5 with acetic acid.

The solutions/suspensions of media resins are applied to a polyester (PET) sheet using the appropriate draw down bar to generate a 15 gsm (grams per square meter) coating after drying in an oven at 200° F.

Green, blue, and red blocks are printed onto the coated sheets using a HP 990 Cxi printer. The prints are mounted on a stainless steel frame and submerged, printed side up, in distilled water at room temperature for 10 minutes. The prints are then removed, held vertically to drain excess water, then placed horizontally to dry. Optical density and L, a, b color of the dry prints are recorded. Little change in optical density and L, a, b color is desireable. Results are below.

| | % OD Loss | | | Delta E | | |
|---|---|---|---|---|---|---|
| resin | Blue | Green | Red | Blue | Green | Red |
| control | 18 | 4 | 13 | 10 | 5 | 16 |
| G | 9 | 10 | 7 | 4 | 6 | 10 |
| J | 9 | 10 | 7 | 3 | 6 | 3 |
| E | 3 | 2 | 2 | 2 | 2 | 3 |

A second set of prints prepared as above are likewise submerged in distilled water at room temperature for 10 minutes. The prints are then removed, held vertically to drain excess water, and subjected to rubbing at constant pressure using a crock meter fitted with a cotton pad. The number of double rubs needed to remove all color is recorded. Results are below.

| | Double rubs needed to remove color | | |
|---|---|---|---|
| resin | Blue | Green | Red |
| control | 1 | 1 | 1 |
| G | 33 | 32 | 30 |
| J | 48 | 50 | 52 |
| E | 83 | 84 | 80 |

Image Quality, Dry Time

A third set of prints prepared as above are tested with a piezo printer. This shows the high performance of the present copolymers when used with a piezo printer where inks have a high glycol content.

A step wedge plot (a series of color blocks with increasing print densities, 10%, 20% etc.) of blue, green, red, and black is printed using an Epson 890 printer and the coating's performance is judged in terms of dry time (smudge resistance versus time and image transfer after dry time) and print quality (ink coalescence for secondary colors). Dry time is good and little to no coalescence is observed for any color.

EXAMPLE 2

Dry Time

This example shows the high performance of the present polymers in formulated coatings of polymer blends.

Media coating formulations are prepared as below:

| | |
|---|---|
| Resin (30% solids in water) | 60 g |
| PVOH polymer (15% solids in water) | 30 g |

The formulations are adjusted to pH 5-6 with acetic acid and applied to polyethylene coated paper sheet using the appropriate draw down bar to generate a 20 gsm (grams per square meter) coating after drying.

Using an Encad 700 printer with GS+ inks, a 4 block pattern of black, cyan, magenta,and yellow is printed on each fully dried formulated sheet. Dry time is measured using a BYK Dry Time Recorder at 67° F./25% relative humidity.

| | Dry Time in Minutes | | | |
|---|---|---|---|---|
| resin | cyan | magenta | yellow | black |
| Control + PVOH | 21 | 17 | 18 | 27 |
| G + PVOH | 3 | 4 | 3 | 5 |
| J + PVOH | 7 | 9 | 6 | 11 |

Dry times for the formulations containing polymers of the present invention are outstanding.

Light Fastness

Coated papers are prepared as above. Color sqares of yellow, magenta and cyan at both 50% and 100% optical densities are printed onto the coated papers using the HP 970 Cxi printer. L,a,b color is then recorded before and after 48 hours of exposure in an Atlas Ci65 Xenon WeatherOmeter, inner and outer borosilicate filters, 50° C., 50% RH, irradiance 0.35 $wm^2$ at 340 nm.

| | delta E 50% print density | | | delta E 100% print density | | |
|---|---|---|---|---|---|---|
| resin | cyan | magenta | yellow | cyan | magenta | yellow |
| Control + PVOH | 15 | 24 | 22 | 14 | 14 | 15 |
| G + PVOH | 15 | 21 | 16 | 12 | 10 | 15 |
| E + PVOH | 11 | 12 | 12 | 13 | 12 | 16 |

The light fastness of the prints on coating formulations containing polymers of the present invention are outstanding.

EXAMPLE 3

Gloss

Media coating formulations are prepared as below:

| | |
|---|---|
| resin (30% solids in water) | 25 g |
| acrylamide copolymer (20% solids in water) | 75 g |
| glycerin | 0.7 g |

The acrylamide copolymer is a copolymer of a 60/15/25 weight ratio of acrylamide/N,N-dimethyl-N-methacryloyloxyethyl-N-(3-sulphopropyl) ammonium betaine/methoxy PEG 350 methacrylate The formulations are adjusted to pH 3 with acetic acid and applied to polyethylene coated paper sheet using the appropriate draw down bar to generate a 20 gsm (grams per square meter) coating after drying. The resulting sheets have the look and feel of photographic paper with little to no difference in gloss when compared to polyethylene coated paper likewise coated with the acrylamide copolymer alone. Results are below.

| resin | 20 degree gloss | 60 degree gloss |
|---|---|---|
| acrylamide copolymer | 70 | 90 |
| G + acrylamide copolymer | 62 | 90 |

Dry Time

Resin formulations and coated sheets are prepared as above.

Using a HP 970 Cxi printer, a 4 block pattern of black, blue, green,and red at 100% print density is printed on the coated sheets. Dry time is recorded as the time required until no visible transfer is observed when subjected to rubbing with a tissue. Results are below.

| | Dry Time in Minutes | | | |
|---|---|---|---|---|
| resin | blue | green | red | black |
| control + acrylamide copolymer | 7 | 2 | 4 | 11 |
| G + acrylamide copolymer | 4 | 2 | 2 | 7 |
| J + acrylamide copolymer | 5 | 2 | 1 | 5 |

The instant polymers provide a fast dry time in the formulated blends.

Light Fastness

Resin formulations and coated sheets are prepared as above.

A resin formulation with resin G is also prepared with an added 1.5 weight percent of tris-(2,2,6,6-tetramethyl-1,4-dihydroxypiperidine) citrate salt (NOH salt).

A fully formulated, commercial, state of the art ink jet paper, Ilford photoglossy paper, is also employed.

Color sqares of yellow, magenta and cyan at both 50% and 100% optical densities are printed onto the coated sheets of the present invention and the Ilford photoglossy paper using the HP 970 Cxi printer. L, a, b color is then recorded before and after 48 hours of exposure in an Atlas Ci65 Xenon WeatherOmeter, inner and outer borosilicate filters, 50° C., 50% RH, irradiance 0.35 $wm^2$ at 340 nm. Results are below.

| | delta E 50% print density | | | delta E 100% print density | | |
|---|---|---|---|---|---|---|
| resin | cyan | magenta | yellow | cyan | magenta | yellow |
| ILFORD | 7 | 10 | 10 | 6 | 7 | 12 |
| G + acrylamide copolymer | 9 | 9 | 8 | 7 | 9 | 10 |
| G + acrylamide copolymer + NOH salt | 6 | 5 | 6 | 4 | 7 | 9 |

EXAMPLE 4

Effect of Removing Acid

| | | | | |
|---|---|---|---|---|
| Time Coating is Dried in Oven Before Print Applied | 10 Minutes | 15 Minutes | 30 Minutes | 60 Minutes |
| Rubs Required to Remove Print from Polymer Composition G | 20 | 36 | 60 | 75 |

The coating is drawn down onto a clear polyester substrate (PET). The emulsion polymer is diluted with distilled water to 15% n.v. and solubilized with acetic acid. The resultant pH is 4.7.

A 60 RDS Meyer bar is used to apply the polymer and the coating is dried at 90° C. for the periods of time specified in the table. Red, green and blue prints are printed on an HP 5550 desktop printer at 65° F. and 7% RH (relative humidity).

The samples are each mounted to stainless steel supports and submerged in room temperature distilled water for 10 minutes. The prints are held vertically to allow the excess water to drain off.

A cotton swab is used to rub the print. The average number of rubs required to remove the printed inks are recorded in the table above.

The results show that sequential removal of the volatile components in a coating of a polymer composition of the present invention improves the wet rub resistance of a printed image made thereon.

What is claimed is:

1. An ink jet recording media system that comprises a support and one or more coating layers thereon, wherein at least one coating layer comprises a copolymer or cooligomer that comprises monomer units derived from at least one monomer selected from the group consisting of the acrylate and acrylamide monomers, at least one monomer selected from the group consisting of the amine containing ethylenically unsaturated monomers, at least one monomer selected from the group consisting of the polyacrylates of polyols and at least one associative monomer selected from the group consisting of stearyl ethoxy (20) methacrylate, stearyl ethoxy (10) allyl ether, poly(ethylene glycol)(meth) acrylate, poly(ethylene glycol)monomethyl ether mono (meth)acrylate, poly(ethylene glycol)acrylate and poly (ethylene glycol)monomethyl ether monoacrylate, which copolymer or cooligomer is at least partially neutralized with acid and in which the at least one coating layer has a pH of from about 3 to about 7 measured in water prior to drying.

2. A recording media system according to claim 1 in which the at least one coating layer has a pH of from about 3 to about 6 measured in water prior to drying.

3. A recording media system according to claim 1 in which the copolymers or cooligomers comprise from about 99.89 to about 0.1 weight percent monomer units derived from at least one monomer selected from the group consisting of the acrylate and acrylamide monomers, about 99.89 to about 0.1 weight percent monomer units derived from at least one monomer selected from the group consisting of amine containing ethylenically unsaturated monomers, and from about 99.8 to about 0.01 weight percent monomer units derived from at least one monomer selected from the group consisting of the polyacrylates of polyols.

4. A recording media system according to claim 1 in which the copolymers or cooligomers comprise from about 20 to about 80 weight percent monomer units derived from at least one monomer selected from the group consisting of the acrylate and acrylamide monomers, about 20 to about 80 weight percent monomer units derived from at least one monomer selected from the group consisting of amine containing ethylenically unsaturated monomers, and from about 0.01 to about 10 weight percent monomer units derived from at least one monomer selected from the group consisting of the polyacrylates of polyols.

5. A recording media system according to claim 1 in which the copolymers or cooligomers comprise from about 30 to about 80 weight percent monomer units derived from at least one monomer selected from the group consisting of the acrylate and acrylamide monomers, about 20 to about 70 weight percent monomer units derived from at least one monomer selected from the group consisting of amine containing ethylenically unsaturated monomers, and from about 0.1 to about 1.0 weight percent monomer units derived from at least one monomer selected from the group consisting of the polyacrylates of polyols.

6. A recording media system according to claim 1 in which the copolymers or cooligomers comprise from about 0.2 to about 0.6 weight percent monomer units derived from at least one monomer selected from the group consisting of the polyacrylates of polyols.

7. A recording media system according to claim 1 in which the acrylate and acrylamide monomers are acrylic or methacrylic esters of alcohols containing from 1 to 22 carbon atoms, the amine containing ethylenically unsaturated monomers are selected from the group consisting of dialkylaminoalkyl acrylates or methacrylates, dialkylaminoalkylacrylamides or methacrylamides, allyl amine, 2-vinylpyridine, 4-vinylpyridine and N', N'-dimethylaminoethyl-N,N-dimethylammonium-N-propyl methacrylate chloride and the polyacrylates of polyols are selected from the group consisting of acrylic and methacrylic esters of aromatic, aliphatic or cycloaliphatic polyols.

8. A recording media system according to claim 1 in which the acrylate and acrylamide monomers are selected from the group consisting of acrylic acid, methacrylic acid, methyl acrylate, ethyl acrylate, butyl acrylate, 2-ethylhexyl acrylate, isobornyl acrylate, methyl methacrylate, ethyl methacrylate and butyl methacrylate, the amine containing ethylenically unsaturated monomers are selected from the group consisting of dimethylaminoethyl acrylate, dimethylaminoethyl methacrylate, diethylaminoethyl methacrylate, dimethylaminopropyl acrylamide, tert-butylaminoethyl methacrylate, dimethylaminopropyl methacrylamide, allyl amine, 2-vinylpyridine, 4-vinylpyridine and N',N'-dimethylaminoethyl-N ,N-dimethylammonium-N-propyl methacrylate chloride and the polyacrylates of polyols are selected from the group consisting of acrylic and methacrylic esters of hydroquinone, 4,4'-dihydroxydiphenyl, 2,2-bis(4-hydroxyphenyl)propane, cresols or alkylene polyols containing 2 to 12 carbon atoms.

9. A recording media system according to claim 1 in which the acrylate and acrylamide monomers are selected from the group consisting of acrylamide, methacrylamide, N-methylacrylamide, N,N-dimethylacrylamide, N,N-dimethyl(meth)acrylamide, N-isopropyl(meth)acrylamide, diacetone acrylamide and N-morpholinoacrylamide, the amine containing ethylenically unsaturated monomers are selected from the group consisting of dimethylaminoethyl acrylate, dimethylaminoethyl methacrylate, diethylaminoethyl methacrylate, dimethylaminopropyl acrylamide, tert-butylaminoethyl methacrylate, dimethylaminopropyl methacrylamide, allyl amine, 2-vinylpyridine, 4-vinylpyridine and N',N'-dimethylaminoethyl-N,N-dimethylammonium-N-propyl methacrylate chloride and the polyacrylates of polyols are selected from the group consisting of acrylic and methacrylic esters of ethylene glycol, 1,2- or 1,3-propanediol, 1,2-, 1,3- or 1 ,4-butanediol, pentanediol, hexanediol, octanediol, dodecanediol, diethylene glycol, triethylene glycol, 1,3-cyclopentanediol, 1,2-, 1,3-or 1,4-cyclohexanediol, 1,4-dihydroxymethylcyclohexane, glycerol, tris(β-hydroxyethyl)amine, trimethylolethane, trimethylolpropane, pentaerythritol, dipentaerythritol, tripentaerythritol, 2,2-bis(4-hydroxyphenyl)propane or sorbitol.

10. A recording media system according to claim 1 in which the acrylate and acrylamide monomers are selected from the group consisting of acrylamide, methacrylamide, methyl acrylate, methyl methacrylate, diacetone acrylamide and N,N-dimethyl acrylamide, the amine containing ethylenically unsaturated monomers are selected from the group consisting of dimethylaminopropyl acrylamide, dimethylaminopropyl methacrylamide, dimethylaminoethyl methacrylate and tert-butylaminoethyl methacrylate and the polyacrylates of polyols are selected from the group consisting of ethylene glycol diacrylate, propylene glycol diacrylate, neopentyl glycol diacrylate, hexamethylene glycol diacrylate, 1,4-butanediol diacrylate, 1,4-butanediol dimethacrylate, bisphenol A diacrylate, bisphenol A diamethacrylate, 4,4'-bis(2-acryloyloxyethoxy)diphenylpropane, trimethylolpropane triacrylate, tris(2-acryloylethyl)isocyanurate, trimethylolethane triacrylate, trimethylolpropane trimethacrylate, trimethylolethane trimethacrylate, tetramethylene glycol dimethacrylate, triethylene glycol dimethacrylate, tetraethylene glycol diacrylate, pentaerythritol diacrylate, pentaerythritol triacrylate, pentaerythritol tetraacrylate, dipentaerythritol diacrylate, dipentaerythritol triacrylate, dipentaerythritol tetraacrylate, dipentaerythritol pentacrylate, dipentaerythritol hexacrylate, tripentaerythritol octacrylate, pentaerythritol dimethacrylate, pentaerythritol trimethacrylate, dipentaerythritol dimethacrylate, dipentaerythritol tetramethacrylate, tripentaerythritol octamethacrylate, 1,3-butanediol diacrylate, 1,3-butanediol dimethacrylate, sorbitol triacrylate, sorbitol tetraacrylate, pentaerythritol-modified triacrylate, sorbitol tetramethacrylate, sorbitol pentacrylate, sorbitol hexacrylate, glycerol di- or-triacrylate and 1,4-cyclohexanediacrylate.

11. A recording media system according to claim 1 in which the copolymers or cooligomers further comprise monomer units derived from at least one ethylenically unsaturated monomer selected from the group consisting of associative monomers, ethylenically unsaturated monomers containing quaternary ammonium groups, hydroxy containing ethylenically unsaturated monomers and other ethylenically unsaturated monomers.

12. A recording media system according to claim 1 in which the copolymers or cooligomers further comprise monomer units derived from at least one ethylenically unsaturated monomer selected from the group consisting of ethylenically unsaturated monomers containing quaternary ammonium groups selected from the group consisting of vinylbenzyltrimethylammonium chloride, methacryloyloxyethyltrimethylammonium chloride, methacrylamidopropyltrimethylammonium chloride, N,N-dimethylaminoethylacrylate methyl chloride quaternary salt (DMAEA.MCQ) and diallyldimethylammonium chloride (DADMAC), hydroxy containing ethylenically unsaturated monomers selected from the group consisting of N-methylolacrylamide, N-methylolmethacrylamide, N-(2-hydroxypropyl)acrylamide, N-(2-hydroxypropyl)methacrylamide, 2-hydroxyethylacrylate, 2-hydroxyethyl(meth)acrylate (HEMA), hydroxypropyl acrylate, hydroxypropyl (meth)acrylate, hydroxybutylacrylate, hydroxybutyl (meth)acrylate, butanediol monovinyl ether and allyl alcohol and other ethylenically unsaturated monomers selected from the group consisting of N-vinyl-2-pyrrolidone, vinyl methylulfone, vinyl acetate, N-vinylformamide, N-vinylacetamide, N-vinyl-N-methylacetamide, styrene, substituted styrenes such as α-methylstyrene, acrylonitrile, methacrylonitrile, vinyl chloride, vinylidene chloride, vinyl ethers, vinyl esters and N-vinyl amides.

13. A recording media system according to claim 1 in which the copolymers or cooligomers comprise monomer units derived from at least one monomer selected from the group consisting of acrylamide, methacrylamide, methyl acrylate, methyl methacrylate, diacetone acrylamide and N,N-dimethyl acrylamide, at least one monomer selected from the group consisting of dimethylaminoethyl methacrylate, t-butylaminoethyl methacrylate and dimethylaminopropyl methacrylamide and pentaerythritol triacrylate.

14. A recording media system according to claim 1 in which the copolymers or cooligomers comprise monomer units derived from at least one monomer selected from the group consisting of acrylamide, methacrylamide and methylmethacrylate, at least one monomer selected from the group consisting of dimethylaminoethyl methacrylate and t-butylaminoethyl methacrylate and pentaerythritol triacrylate.

15. A recording media system according to claim 1 in which the copolymers or cooligomers comprise monomer units derived from methyl methacrylate, dimethylaminoethyl methacrylate or t-butylaminoethyl methacrylate and pentaerythritol triacrylate.

16. A recording media system according to claim 1 in which the copolymers or cooligomers comprise monomer units derived from methyl methacrylate, dimethylaminoethyl methacrylate or t-butylaminoethyl methacrylate, pentaerythritol triacrylate and stearyl ethoxy (10) allyl ether or poly(ethylene glycol) 350 monomethyl ether mono(meth)acrylate.

17. A recording media system according to claim 1 which comprises a coating directly on a support, wherein the coating comprises the copolymer or cooligomer.

18. A recording media system according to claim 1 which comprises a support and at least one ink jet ink receptive layer, wherein one or more than one of said receptive layers comprises the copolymer or cooligomer.

19. A recording media system according to claim 18, in which one or more than one of said receptive layers further comprises at least one polymer selected from the group consisting of gelatin, starch, styrene butadiene rubber latex, nitrile butadiene rubber latex, polyethylene glycol, polyacrylamide, polyvinylalcohol, vinyl alcohol/vinyl acetate copolymer, methyl cellulose, hydroxymethyl cellulose, hydroxyethyl cellulose, hydroxypropy methyl cellulose, hydroroxypropyl ethyl cellulose, hydroxyethyl methyl cellulose, carboxymethyl cellulose, poly(N-vinyl pyrrolidone) and cationic polymers.

20. A recording media system according to claim 18 which further comprises a barrier layer between the support and the ink receptive layer or layers.

21. A recording media system according to claim 1 which comprises a support, at least one ink jet ink receptive layer, and a protective coating layer, wherein said protective coating layer comprises the copolymer or cooligomer.

22. A recording media system according to claim 18 which comprises a protective coating layer.

23. A recording media system according to claim 18 which comprises a protective coating layer, wherein said protective coating layer comprises the copolymer or cooligomer.

24. A recording media system according to claim 20 which comprises a protective coating layer.

25. A recording media system according to claim 20 which comprises a protective coating layer, wherein said protective coating layer comprises the copolymer or cooligomer.

26. A recording media system according to claim 1 which further comprises ink jet ink.

27. A recording media system according to claim 1 which further comprises one or more pigments, fillers or organic particulates selected from the group consisting of amorphous silica, crystalline silica, aluminum trihydrate, kaolin, talcum, chalk, betonite, zeolite, glass beads, calcium carbonate, potassium sodium aluminum silicate, diatomaceous earth, silicates of aluminum, silicates of magnesium, titanium doxide, polyolefins, polystyrene, polyurethane, starch, poly(methyl methacrylate) and polytetrafluoroethylene.

28. A recording media system according to claim 1 which further comprises one or more additives selected from the group consisting of surface active agents, antistatic agents, thickeners, suspending agents, pH controlling compounds, light stabilizers, antioxidants, humectants, bacteriostats, crosslinking agents and optical brighteners.

29. A recording media system according to claim 28 in which the additives are selected from the group consisting of phenolic antioxidants, hydroxybenzotriazole ultraviolet light absorbers, benzophenone ultraviolet light absorbers, hydroxyphenyltriazine ultraviolet light absorbers and hindered amine light stabilizers.

30. A recording media system according to claim 29 in with the hindered amine light stabilizers are selected from the group consisting hindered nitroxyl, hindered hydroxylamine and hindered hydroxylamine salt stabilizers.

31. A recording media system according to claim 29 in which the phenolic antioxidants are salts of hydroxy substituted benzoic acids.

32. A recording media system according to claim 1 in which said support comprises cellulose esters, cellulose acetate, polyesters, polystyrene, polyethylene, poly(vinyl acetate), polypropylene, polycarbonate, polymethacrylic acid and methyl and ethyl esters, polyamides such as nylons, polyesters such as poly(ethylene terephthalate) (PET), polyimides, polyethers, polyvinyl chloride or polysulfonamides.

33. A recording media system according to claim 1 in which said support is paper or transparent poly(ethylene) terephthalate.

34. A recording media system according to claim 1 which comprises a nanoporous or microporous coating layer.

35. A recording media system according to claim 1 in which the acid is selected from the group consisting of mineral acids carboxylic acids or sulfonic acids.

36. A recording media system according to claim 1 where the acid employed is acetic acid, propionic acid, glycolic acid or lactic acid.

37. A recording media system according to claim 1 where the acid employed is acetic acid.

* * * * *